US005662468A

United States Patent [19]

Henderson

[11] Patent Number: 5,662,468

[45] Date of Patent: Sep. 2, 1997

[54] DEVICE THAT PREVENTS FLAREUP IN LIQUID FUEL BURNERS

[76] Inventor: Richard W. Henderson, P.O. Box 12681, Florence, S.C. 29504

[21] Appl. No.: 514,583

[22] Filed: Aug. 14, 1995

[51] Int. Cl.[6] ..... F23D 3/02

[52] U.S. Cl. ..... 431/302; 431/33; 126/96

[58] Field of Search ..... 431/302, 33; 126/96; 137/587, 43, 202

[56] References Cited

U.S. PATENT DOCUMENTS

| | | | |
|---|---|---|---|
| 1,392,187 | 9/1921 | Mahan | 137/405 |
| 1,623,161 | 4/1927 | Buerger | 137/405 |
| 1,706,704 | 3/1929 | Phillips | 137/405 |
| 1,725,538 | 8/1929 | Remnsnider | 137/405 |
| 2,165,162 | 7/1939 | Thornton | 431/117 |
| 3,169,519 | 2/1965 | Aizawa . | |
| 3,501,252 | 3/1970 | Richardson . | |
| 4,363,620 | 12/1982 | Nakamura . | |
| 4,664,095 | 5/1987 | Takahashi . | |
| 4,797,088 | 1/1989 | Nakamura . | |
| 4,872,831 | 10/1989 | Fujimoto . | |
| 5,080,578 | 1/1992 | Josephs . | |
| 5,165,883 | 11/1992 | Van Bemmel . | |
| 5,338,185 | 8/1994 | Henderson et al. | 431/34 |
| 5,409,370 | 4/1995 | Henderson | 431/2 |
| 5,456,595 | 10/1995 | Henderson | 431/2 |
| 5,549,470 | 8/1996 | Henderson | 431/302 |

FOREIGN PATENT DOCUMENTS 1205018 9/1970 United Kingdom .

OTHER PUBLICATIONS

Richard W. Henderson and George R. Lightsey, "Kerosene Heater Fires: Barometric Type," *Fire Marshals Bulletin* (87–5), pp. 8–10, Nov. 1987.

Richard W. Henderson and George R. Lightsey, "Kerosene Heater Fires: Barometric Type", *The National Fire and Arson Report*, vol. 6(1), pp. 2–4 (1988).

Richard W. Henderson, "Barometric Kerosene Heaters", *Fire and Arson Investigator*, vol. 39(3), pp. 26–27 (1989).

John J. Lentini, "Gasoline and Kerosene Don't Mix—At Least, Not in Kerosene Heaters", *Fire Journal*, vol. 83 (4), pp. 13, 86 (1989) (Jul.–Aug.).

Richard W. Henderson and George R. Lightsey, "An Anti–Flareup Device for Barometric Kerosene Heaters," *Fire and Arson Investigator*, vol. 45 (2), 8(1994).

*Primary Examiner*—Larry Jones

*Attorney, Agent, or Firm*—David Pressman

[57] ABSTRACT

A safety device for preventing uncontrolled burning in wick-fed liquid fuel burners employs a vapor closure system that contains vapors present around the removable tank (60). Also, a tank block mechanism is provided to prevent the reseating of the removable tank (60) into the fuel chamber (40) to its normal position when excess fuel is present in the fuel chamber.

6 Claims, 2 Drawing Sheets

DEVICE THAT PREVENTS FLAREUP IN LIQUID FUEL BURNERS

BACKGROUND—CROSS-REFERENCE TO RELATED APPLICATIONS

This invention is an improvement over the inventions of several earlier applications, to-wit: Ser. No. 08/130,290, filed 1993 Oct. 4, now U.S. Pat. No. 5,338,185, granted 1994 Aug. 16, in the names of Richard W. Henderson and George R. Lightsey; Ser. No. 08/247,925, filed 1994 May 23, now U.S. Pat. No. 5,456,595, granted 1995 Oct. 10 in the name of Richard W. Henderson; Ser. No. 08/297,048, filed 1994 Sep. 30, now U.S. Pat. No. 5,409,370, granted 1995 Apr. 25, in the name of Richard W. Henderson; and Ser. No. 08/365,804, filed 1994 Dec. 29, now U.S. Pat. 5,549,470, granted 1996 Aug. 27, in the name of Richard W. Henderson.

BACKGROUND—FIELD OF INVENTION

This invention relates to safety devices, specifically to a mechanism for prevention of flareup in barometric-type wick-fed liquid fuel burners.

BACKGROUND—DISCUSSION OF PRIOR ART

In wick-fed liquid fuel burners, such as kerosene heaters, liquid fuel from a fuel chamber is supplied to a wick which is exposed to the oxygen of the atmosphere. Once the wick has been ignited, flame intensity and heat generation are controlled by positioning the wick within a wick-receiving combustion chamber.

A common type of kerosene heater is the barometric style, in which gravity causes liquid fuel to be delivered to a horizontal fuel chamber from a vertically-oriented, removable tank inserted into the fuel chamber. The flow of fuel from the removable tank into the fuel chamber is governed by a barometric valve in the cap on the removable tank, which, in normal operation, maintains the level of the fuel in the fuel chamber at the level of the barometric valve. A partial vacuum above the fuel in the removable tank prevents the fuel from flowing into the fuel chamber until the fuel level in the fuel chamber drops below the barometric valve, which allows air to enter the removable tank. As air enters the removable tank through the barometric valve, fuel in the removable tank flows into the fuel chamber until its level in the fuel chamber rises and covers the barometric valve in the removable tank cap, at which point fuel flow from the removable tank will cease.

The barometric valve consists of a spring-loaded plunger, which has an enlarged head at one end. When the removable tank is inserted into the fuel chamber, the plunger head contacts a pin located in the fuel chamber, which pushes the plunger back, allowing the fuel in the removable tank to be in fluid communication with the fuel chamber.

When the tank is removed, the action of the spring on the plunger head forces it against the opening in the tank cap, sealing the opening and preventing fuel from leaving the tank. The capacity of the removable tank is typically about four to five liters (four to five quarts), while the fuel chamber can hold a maximum of about two liters (two quarts).

Various improvements have been made to such burners which make them safer to operate. For example, tip-over shut-off mechanisms, manual shut-off devices, and low-level $O_2$ detectors have been employed. However, these burners continue to cause fires that result in death, injury, and property loss. These fires are caused, because, under certain conditions, fuel can overflow the fuel chamber.

When the overflowing fuel ignites, the result is an uncontrolled fire, or flareup.

The most common reason for fuel overflow is the inadvertent use of fuels with high vapor pressures. Examples of such fuels are gasoline, naphtha, and inferior kerosene, which has a low flash point. In a barometric heater, overflow of fuel from the fuel chamber can occur if the partial vacuum in the removable tank is lost. As the temperature of the heater and its surroundings increases, the vapor pressure of the fuel in the removable tank increases and, under certain conditions, allows fuel to escape from the removable tank at a rate greater than the rate of burning of the fuel. Should this process continue, the fuel chamber will overflow, since the removable tank holds about two to three liters more than the capacity of the fuel chamber. When the fuel chamber overflows, the fuel spills onto the top of the fuel chamber, and can then ignite, causing an uncontrolled fire. A second way that the partial vacuum in the barometric heater's removable tank can be lost is by air entering through compromise of the integrity of the removable tank.

There are safety devices that drop the wick down, thereby extinguishing the flame, if the burner tips over or experiences excessive vibration, or if abnormal combustion is detected. Other safety devices detect high levels of $CO_2$ and low levels of $O_2$ in the vicinity of the heater, and use these to control burning rates. Still others regulate the position of the wick during the ignition and extinguishing operations of the heater to prevent excessive flaming during these operations. Examples are shown in U.S. Pat. Nos. 4,363,620, issued Dec. 14, 1982 to Nakamura; 4,872,831, issued Oct. 10, 1989 to Fujimoro; 4,797,088, issued Jan. 10, 1989 to Nakamura; and 5,165,883, issued Nov. 24, 1992 to Van Bemmel. However, not only do these devices fail to prevent flareup, they are ineffective in stopping flareup after its onset. In some cases, the safety devices require the use of electrical power and electronic circuitry for actuation, and would increase the cost of the burners significantly, without rectifying the flareup problem.

It has been suggested in two publications ("Kerosene Heater Fires: Barometric Type," R. Henderson et al., *Fire Marshals Bulletin* (*National Fire Protection Association*), Vol. 87-5, p. 8 (1987); "Barometric Kerosene Heaters," R. Henderson, *Fire and Arson Investigator* (International Association of Arson Investigators), Vol. 39, No. 3, p. 26 (1989)) to make the size of the removable tank of barometric kerosene heaters comparable in volume to that of the fuel chamber so that flooding of the fuel chamber will not occur. To implement this suggestion, either the capacity of the removable tank must be reduced, or alternatively, that of the fuel chamber must be increased. However, reducing the capacity of the removable tank will reduce the burn time accordingly, and possibly affect the marketability of the heaters. Increasing the capacity of the fuel chamber will require that new tanks be designed and implemented.

Also, it has been suggested that a float device be introduced into the fuel chamber to be used to activate the automatic wick extinguishing mechanism, and a sight gauge be present to show dangerous fuel levels in the fuel chamber. Introduction of such a float device would also require that the fuel chamber be redesigned, as discussed above. Although some burners have sight gauges in the fuel chamber, the sight gauges are used only to indicate whether or not fuel is present, not when dangerous fuel levels are present in the fuel chamber.

In addition it was proposed that a tank block-out device be installed. In this, a float in the fuel chamber pushes a pin that moves if the removable tank is withdrawn from the heater. Once again, such a device would require a redesigning of the fuel chamber and insertion of moving parts inside a somewhat restricted space.

U.S. Pat. No. 5,080,578, issued Jan. 14, 1992 to Josephs, claims that its device controls flareup in wick-fed liquid fuel burners by a) cutting off the flow of fuel to the wick in response to excessive heat by blocking a fuel line, and b) withdrawing the wick into the wick chamber when sensing excessive heat. However, Josephs' device has several disadvantages:

a) Excessive heat must be generated near the sensors before the flow of fuel is interrupted, or the wick is withdrawn. Therefore, since flareup is not prevented, the device only limits the spread of excessive flames after flareup has already occurred.

b) Excessive heat sensing devices must be near the area where uncontrolled burning is taking place due to overflow of fuel. Often the path that the overflowing fuel takes is random and flareup may not initially occur near the heat sensors.

c) The device is not applicable to barometric liquid fuel burners—the most common wick-fed liquid fuel burners in use—because these burners do not have fuel lines.

d) From the onset of flareup in wick-fed liquid fuel burners, fire is present outside the wick; therefore, retracting the wick does not affect the flareup process.

The device of the above-referenced related patent of Henderson and Lightsey consists, in part, of an excess fuel containment compartment below the level of the fuel chamber. It prevents flareup by activating a wick-extinguishing mechanism when the presence of excess fuel is detected in the fuel chamber. While this device has much merit, to be effective it requires activation of a second mechanism, that is, an automatic wick extinguisher. Should that mechanism fail to respond, due to tar buildup on the wick or a mechanical problem, flareup may still occur in some situations.

The device of the above-referenced related patent of Henderson prevents flareup by dropping the pin which holds open the barometric valve in the removable tank cap, thereby closing the valve and stopping fuel flow into the fuel chamber. Should the valve not close properly, or should some other mechanical malfunction occur, this device may not prevent flareup in some situations.

The device of the first above-referenced related patent application of Henderson, Ser. No. 08/247,925, prevents flareup by lifting the removable tank when excess fuel is present in the fuel chamber, thereby shutting off the barometric valve and stopping fuel flow from the removable tank. For this device to work, it is necessary to provide a spring to lift the removable tank and its contents (liquid fuel), the total weight of which can be up to some five kilograms (ten pounds). Accordingly, should the spring lose strength, or should the removable tank become hindered in its upward movement, this device may not be able to prevent flareup in some situations.

The device of the second above-referenced related patent application of Henderson, Ser. No. 08/365,804, prevents flareup by providing a thermal barrier between the combustion cylinder and the removable tank, which helps lower the temperature of the removable tank so that fuel vapor pressures do not become excessive. In addition, it includes a warning gauge that alerts the user to the dangerous condition of the burner when excess fuel is present in the fuel chamber. It also provides an excess fuel containment system that can hold the entire contents of the removable tank should all the fuel be released rapidly.

This system consists, in part, of a fuel containment sump, which extends upward from the top of the fuel chamber, and which surrounds the removable tank, but which does not have a closure at its top. This device has much merit in that it is effective without involving any moving parts for its operation. However, since the fuel containment sump is open at the top, fumes can escape around the tank and may be ignited by the wick flame. Also, should the removable tank be filled and inserted into the sump when excess fuel is already present in the reservoir, an additional charge of fuel may be introduced into the fuel containment system. The additional fuel may cause overflow of the reservoir, which could result in flareup.

OBJECTS AND ADVANTAGES

Accordingly, several objects and advantages of the present invention are to provide an improved and safer wick-fed, barometric, liquid fuel burner, to provide such a burner with a safety device which does not require the reduction in capacity of the removable fuel tank, does not require the redesigning of the fuel chamber to increase its capacity or to accommodate a float device, does not require electrical power or electronic circuitry, does not require the presence of excessive heat for its actuation, is applicable to kerosene heaters that do not have fuel lines, provides a containment means for fumes around the removable tank, and provides for a block-out mechanism for the removable tank such that the removable tank cannot be properly inserted into the fuel chamber when excess fuel is present in the fuel chamber.

Another object is to provide such a burner with a safety device which prevents fuel overflow from the fuel chamber, and therefore, prevents flareup.

In addition, the present burner does not have any substantially increased weight, will save lives and property, will make barometric liquid fuel burners easier to market because of added safety value, and will likely reduce the number of expensive lawsuits prompted by injury, loss of life, and property damage.

Still further objects and advantages will become apparent from a consideration of the ensuing description and drawings.

DRAWING REFERENCE NUMERALS

Figure 1:
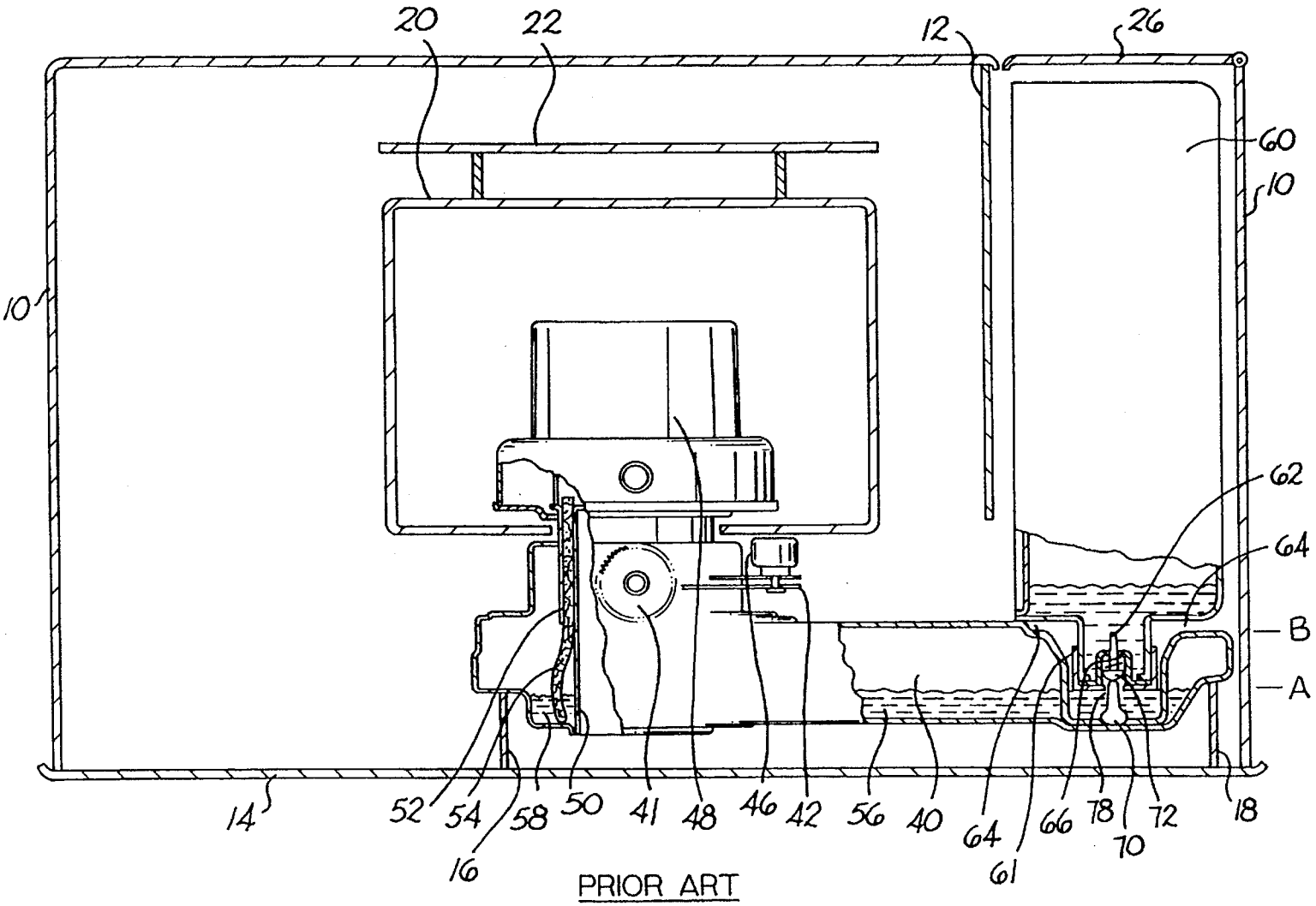
PRIOR ART FIG. 1
FIG. 1 is a side sectional view of a prior-art, wick-fed, barometric liquid fuel burner with an automatic wick extinguishing unit that can be activated by a vibration-sensing weight.

10 Cabinet
12 Tank guide
14 Base tray
16 Support
18 Support
20 Reflector
22 Plate
24 Fuel containment compartment
26 Lid

28 Support
30 Overflow tube
32 Deflector
34 Air diverter
36 Support
38 Support
40 Fuel chamber
41 Wick gear
42 Automatic wick extinguishing unit
44 Fuel containment sump
46 Vibration-sensing weight
48 Combustion cylinder
50 Inner wick guide
52 Outer wick guide
54 Wick
56 Fuel
58 Fuel supply reservoir
60 Removable fuel tank
61 Tank cap
62 Plunger
64 Opening
66 Plunger spring
68 Support
70 Pin
72 Plunger head
76 Opening
78 Orifice
80 Opening
82 Orifice
84 Float
86 Arm
88 Sleeve
90 Warning gauge needle
92 Cover plate
94 Support
96 Support
98 Pivot point
100 Arm
102 Float
A Normal fuel level
B Flooded fuel level

SUMMARY

In accordance with the present invention, an anti-flareup safety device for wick-fed, barometric liquid fuel burners provides a complete closure around the removable tank so that during operation of the burner, the closure will prevent any vapors present in the vicinity of the removable tank from reaching the wick flame.

The safety device includes a tank-block mechanism that, when there is excess fuel in the fuel chamber, prevents the removable tank from being re-inserted into the sump sufficiently to allow the pin to depress the plunger in the barometric valve in the removable tank cap.

DESCRIPTION—CONVENTIONAL HEATER STRUCTURE—FIG. 1

FIG. 1 is a side sectional view of a conventional barometric liquid-fuel burner (as described supra) that operates by burning a liquid fuel, such as kerosene. The burner is a wick-fed type with a combustion cylinder 48 and is constructed with basic components typical of burners widely known in the art. One manufacturer of the burner of FIG. 1 is Toyotomi of Japan, and such manufacturer sells such burners under the trademark Envirotemp by Kero-Sun.

In normal operation fuel is delivered from a removable fuel tank 60 to a horizontal fuel chamber 40 through an orifice 78 in a tank cap 61 on tank 60. Tank 60 is held in a vertical position by a tank guide 12 in a cabinet 10 in accordance with the common practice of the industry. Cap 61, which is attached to the neck of tank 60, is inserted into a mating well, or sump, in the top surface of chamber 40, also the common practice in the industry.

When the fuel level in chamber 40 drops below level A due to fuel consumption by wick 54, air will bubble into tank 60 through orifice 78 in tank cap 61, and fuel will flow from tank 60 into chamber 40 until the level in chamber 40 rises back to level A. A partial vacuum above the fuel in tank 60 maintains the fuel in tank 60 above level A until all of the fuel has been discharged from tank 60. Fuel 56, which is in fluid communication with wick 54 via wick fuel supply reservoir 58, migrates by capillary action up the wick and is burned inside combustion cylinder 48, which generally consists of several inner metal cylinders and an outer glass cylinder. Cylinder 48 provides a surface for the burning of the fuel, and radiates heat and some light. The flame is not shown, but is seen as a red glow above the wick in cylinder 48.

Wick 54, cylindrical in shape and shown in a partial cross-sectional view, can be moved up or down between inner wick guide 50 and outer wick guide 52 by rotating a wick gear 41. Wick 54, wick guides 50 and 52, combustion cylinder 48, wick fuel supply reservoir 58, and vibration-sensing weight 46 in FIG. 1 are circular in shape when seen from above, whereas compartment 40 is generally rectangular. Removable fuel tank 60 is most commonly rectangular in shape as viewed from above, but various other shapes are also found, such as triangular. Tank cap 61 is cylindrical in shape, and is threaded to allow attachment to tank 60.

The fuel burner has an automatic wick extinguishing unit 42, which includes a vibration-sensing weight 46. If the burner is tilted or vibrated excessively, this could spill the fuel and create a fire. To prevent this, unit 42 senses the vibration, and disengages wick gear 41, which lowers wick 54, extinguishing the flame, or actuates any other wick extinguishing mechanism (not shown).

The burner components are attached to base tray 14 through supports 16 and 18, which tray provides stability to hold the unit in an upright position in the typical fashion of the industry. Tray 14 is generally rectangular, with dimensions of approximately 90 cm (3 ft) by 30 cm (1 ft). The bottom of chamber 40 is about 5 cm (2 in) above tray 14.

A polished metal reflector 20 directs the heat from combustion cylinder 48 out of the front of the burner, in the typical fashion of the industry. A metal plate 22 extends horizontally above reflector 20; plate 22 is typically rectangular in shape, and acts to reduce the operating temperature of the top of cabinet 10. In some burners, several plates are utilized, being stacked above each other and separated by about 1 cm (0.5 in) from each other. A lid 26 is located over the removable tank location, and is hingedly connected to cabinet 10 so that tank 60 can be inserted into and removed from the cabinet.

OPERATION AND DANGER OF FLAREUP WITH CONVENTIONAL BURNER—FIG. 1

If the partial vacuum in tank 60 is lost, the barometric system described earlier no longer regulates fuel flow from tank 60. The partial vacuum may be lost by compromise of the integrity of tank 60, or by the presence of a high vapor pressure fuel in tank 60. Most flareup incidents occur when a high-volatility fuel is inadvertently introduced into tank 60—most commonly, gasoline or gasoline-contaminated fuel. As a result, excessive fuel will flow into chamber 40. Since the capacity of tank 60 is about two liters greater than that of chamber 40, chamber 40 will not be able to contain all of the fuel from tank 60, if any significant amount of fuel is present in tank 60. As a result, fuel fills chamber 40 and when it reaches level B, overflows via opening 64 between tank 60 and the top of chamber 40. The fuel spreads over the fuel chamber's surface and to other areas in the burner. The flooded fuel will ignite because the vapors from the leaked fuel are drawn by air movement toward the wick flame (not shown) in cylinder 48, which is of sufficient temperature to ignite these fumes. As a result, there will be flames in and around tank 60, causing the pressure inside tank 60 to increase dramatically, driving more fuel out of tank 60, which further increases the amount of escaped fuel, and accordingly increases the severity of the flareup.

The flareup incidents involving high-volatility fuels do not occur immediately after the burners are lit, but rather after an induction period of one or more hours. There is a delay because these burners are utilized for heating purposes at cooler ambient temperatures. At such temperatures, even the high-volatility fuels have vapor pressures low enough that the partial vacuum above the liquid in the removable tank is adequate to maintain the column of fuel in the tank, which requires a pressure differential of only approximately 3 kPa (0.4 psi) for the 36 cm (14 in) height typical of removable tanks.

For example, at 21° C. (70° F.) the vapor pressure of the most volatile class of gasoline, Class E, is on the order of 69 kPa (10 psi). Since ambient pressure is around 101 kPa (14.7 psi), a column of gasoline nearly 5 m (15 ft) high could be maintained at such a pressure differential. However, should the temperature of the gasoline reach 38° C. (100° F.)— the approximate boiling point of gasoline—its vapor pressure will increase to about 101 kPa (14.7 psi), and the fuel will flow out of the removable tank and into the fuel chamber in an uncontrolled manner. This will circumvent the normal operation of the barometric valve. The increase in temperature of the air space in the removable tank during operation of the burner is not a significant factor in the loss of the partial vacuum in the removable tank. This is because the temperature increases are not rapid enough to overcome the normal action of the barometric valve in controlling fuel flow from the removable tank as fuel is consumed by the wick.

Unless the burner is in a very low temperature environment, the temperature of the removable tank will typically exceed 38° C. (100° F.) during operation of the burner. The removable tank achieves such temperatures due to its proximity, about 13 cm (5 in), to the combustion process, which reaches temperatures in excess of 850° C. (1600° F.). During operation of the burner, heat is transferred by radiation, convection, and conduction processes from the reflector to the tank guide. The tank guide is immediately adjacent to and in contact with the removable tank, and is present to maintain the positioning and vertical orientation of that tank. In addition, during operation of the burner, there is a significant increase in temperature of the top surface of the cabinet, in particular, in the vicinity of the tank guide. This results in a corresponding increase in temperature of the tank guide, and accordingly, the removable tank.

The typical flareup scenario in such burners is as follows: Initially, the fuel in the removable tank is at a low enough temperature so that its vapor pressure is insufficient to allow liquid to flow from the removable tank beyond that allowed by the barometric valve. At this point, the liquid level in the fuel chamber will be maintained at the level of the barometric valve, which allows fuel to flow from the removable tank into the fuel chamber only as fuel is consumed by the wick. The temperature of the removable tank, and the fuel inside it, increases as thermal equilibrium is established in the burner, causing the vapor pressure of the fuel to increase. Then the increased vapor pressure of the fuel compromises the partial vacuum inside the removable tank, allowing fuel in the removable tank to flow into the fuel chamber in an uncontrolled manner. Since the capacity of the removable tank (4–5 liters) far exceeds that of the fuel chamber (1–2 liters), the fuel chamber fills and overflows. The vapors from the spilled fuel ignite and flareup ensues.

With the exception of the Henderson and Lightsey device, and the Henderson tank-lift, pin-drop, and thermal barrier/fuel containment devices, prior-art safety/devices do not prevent flareup, but rather detect evidence that flareup has begun, and then trigger an automatic wick extinguishing unit, which acts to extinguish the flame on the wick. However, by the time flareup has begun, there are flames outside the wick area and extinguishment of the wick flame does not affect the progression of flareup. The flames are present where fuel has flooded, and the increasing amounts of fuel being discharged from the removable tank further increase the magnitude of the flareup incident, as described earlier.

The Henderson and Lightsey device is designed to extinguish the flame on the wick prior to flareup. However, if the wick-drop mechanism fails to operate when activated as a result of the wick becoming encrusted, or if there is some other problem with the wick shut-off mechanism, this device may not be able to prevent flareup. The Henderson tank lift and pin-drop devices are designed to shut off fuel flow from the removable tank to the fuel chamber by separating the removable tank from the pin that opens the barometric device in the cap on the removable tank cap. However, these two Henderson devices have one feature in common; should they not operate properly to shut the heater off, the fuel chamber may overflow and flareup may result.

The Henderson thermal barrier/fuel containment device is a very simple and effective device; however, vapors in the vicinity of the removable tank may be drawn to the wick flame by the air movement in the burner, where they could be ignited. Also, should excess fuel already be present in the fuel chamber, and additional fuel be introduced via the removable tank, it is possible that the fuel in the removable tank could be lost faster than the wick flame could consume it, which could result in flooding of the fuel containment system, and possibly flareup.

Thus, prior-art safety devices, such as those which monitor excessive vibration of the burner, which detect high levels of $CO_2$ and low levels of $O_2$, which detect abnormal combustion, and which regulate the position of the wick to prevent excessive flaming, are ineffective in preventing flareup. The safety device described in the Josephs patent, supra, does not prevent flareup, but rather provides a wick-drop mechanism, and cuts off fuel flow through a fuel line after the onset of flareup. Since the wick-fed barometric liquid fuel burners in common use do not utilize a fuel line, Josephs' device is not applicable to them. The Henderson and Lightsey, and the Henderson tank-lift and pin-drop devices are designed to prevent flareup, but should they not activate properly, flooding of the fuel chamber may occur and flareup may result. In the case of the Henderson thermal barrier/fuel containment device, vapors around the removable tank may escape and be ignited by the wick flame. Should the fuel containment system already contain excess fuel, flooding may occur if the removable tank is inserted with additional fuel and the loss of fuel from that tank is faster than the wick flame can consume it.

DESCRIPTION OF INVENTIVE ANTI-FLAREUP DEVICE—FIG. 2

Figure 2:
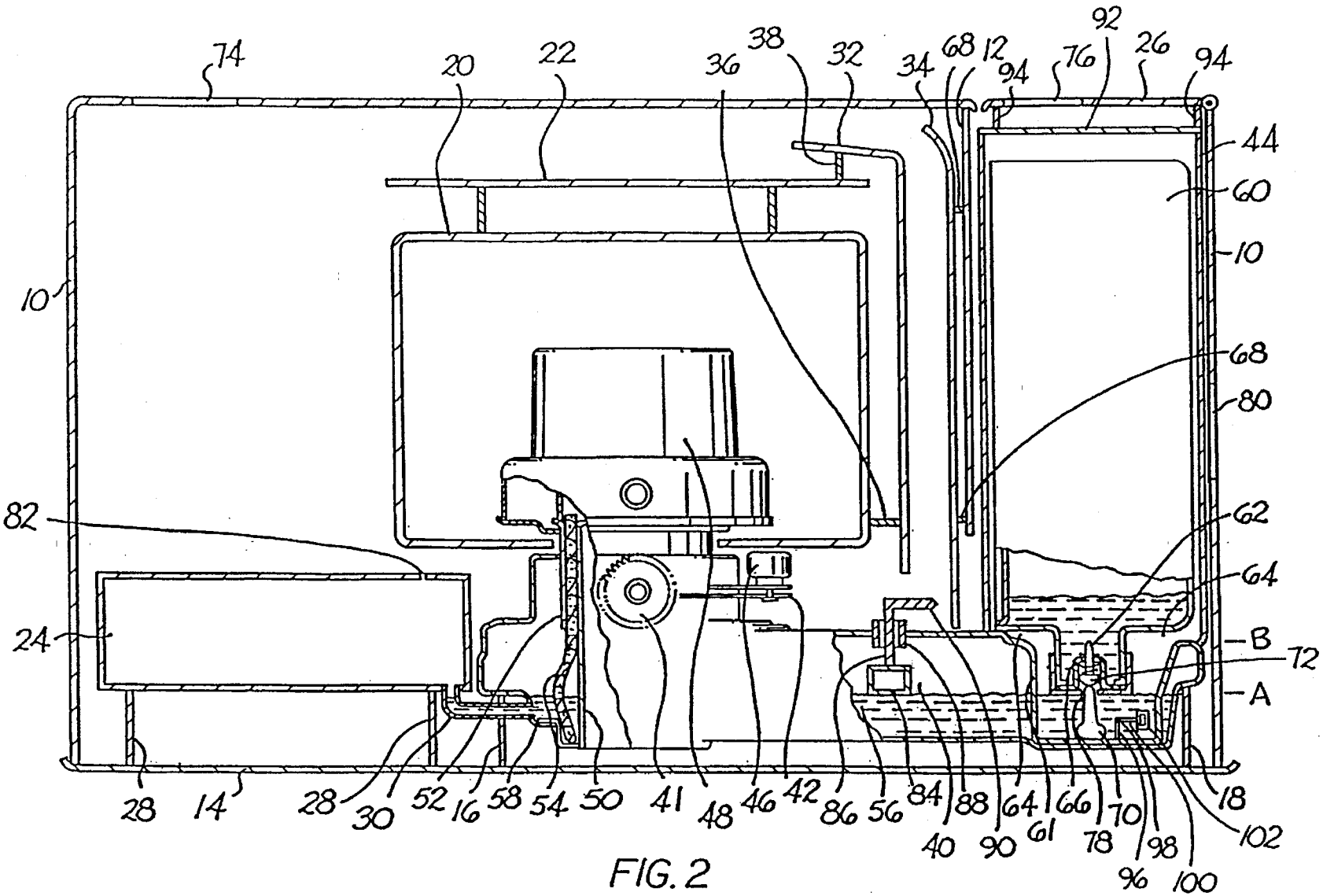
FIG. 2 is a side sectional view of a wick-fed, barometric liquid fuel burner with an anti-flareup safety device in accordance with the preferred embodiment of the present invention.

These problems are solved by the wick-fed barometric liquid fuel burner of FIG. 2. It operates by providing: a) a vapor containment system for any fumes present around the removable tank, and b) a tank-block mechanism that prevents the proper re-seating of the removable tank in the sump when there is excess fuel in the fuel chamber. It includes the following conventional elements: a removable tank 60 with a tank cap 61 which houses a spring-loaded plunger 62 functioning as a barometric valve in the usual fashion of the industry, a fuel chamber 40, a wick 54, a wick gear 41, a combustion cylinder 48, a vibration-sensing weight 46, a base tray 14, an automatic wick extinguishing unit 42, a cabinet 10 with a lid 26 over the opening for tank 60, a reflector 20, a plate 22, and a tank guide 12. It also contains the elements of the Henderson thermal barrier/fuel containment device, specifically, deflector 32, air diverter 34, opening 74, opening 76, opening 80, fuel containment sump 44, fuel containment compartment 24, orifice 82, tube 30 float 84, arm 86, sleeve 88, and warning gauge needle 90.

In addition, the burner of FIG. 2 includes additional elements which constitute a preferred embodiment of the present inventive anti-flareup safety device. A cover plate 92 is located below lid 26. Also, a float 102 is attached to an arm 100, which moves about a pivot point 98, which is secured to a convenient frame member in the sump area by support 96. When viewed from above, plate 92 is preferably rectangular in shape, but may be of other shapes. The dimensions of plate are approximately 15 cm (6 in) by 10 cm (4 in), and it is about 0.1 cm (1/16 in) thick.

Float 102 may be spherical or other convenient shape, so long as it fits in the available space in the vicinity of pin 70, such that It is free to move about pivot point 98, and such that it has sufficient displacement, about 1 $cm^3$ (0.06 $in^3$), to cause float 102 to move upward when fuel envelops it. Float 102 is constructed such that Its center of gravity is displaced about pivot point 98 such that float 102 will normally be in a downward position. Float 102 may be cork, plastic, or other material of appropriate low density. Arm 100 is about 1 cm (0.4 in) long and 0.3 cm (0.01 in) in diameter. It may be composed of metal, plastic, or other convenient material. Support 96 is about 1 cm (0.4 in) long and 0.3 cm (0.01 in) in diameter, and may be composed of metal, plastic, or other convenient material.

OPERATION OF INVENTIVE ANTI-FLAREUP DEVICE—FIG. 2

After ignition of the wick, the burner components begin to increase in temperature. The hottest location in the burner components is in the vicinity of cylinder 48, especially over it. As reflector 20, plate 22, deflector 32, and air diverter 34 become warmer during operation of the burner, tank guide 12, and tank 60 also become warmer. As tank 60 becomes warmer, the fuel inside will become warmer, causing the vapor pressure of the fuel to increase. If a high-volatility fuel, such as gasoline, is present, the vapor pressure will be quite significant, and vapor from the fuel will accumulate around removable tank 60. The vapors will not be able to escape from fuel containment sump 44 due to its confinement by cover plate 92.

Should there be a substantial drop in ambient pressure and/or a simultaneous significant temperature excursion by the fuel in tank 60, the pressure differential between the inside and the outside of tank 60 may not be sufficient to maintain the column of fuel inside tank 60, when a high-volatility fuel such as gasoline is present. As a result, fuel will flow into chamber 40 from tank 60 in an uncontrolled manner. Since the combined capacity of chamber 40, sump 44, and compartment 24 exceeds the capacity of tank 60, overflow of fuel will not occur.

Should excess fuel enter chamber 40, float 84 will be urged upward. Concomitantly, arm 86 will move upward, causing needle 90 to deflect, thereby providing warning of the dangerous condition of the burner.

If tank 60 is removed for re-filling when there is excess fuel in the fuel chamber, float 102 will be urged upward in response to the presence of the excess fuel in chamber 40. If an attempt is made to re-insert tank 60 into the burner, float 102 will block tank 60 from seating properly, such that pin 70 will not push plunger 72 to an open position. As a result, no additional fuel will flow from tank 60 into chamber 40. The wick will continue to burn until the fuel in the fuel chamber is consumed. When the fuel level in chamber 40 drops below level A, and tank 60 is lifted, float 102 will move back to its normal downward position, due to the displaced center of gravity of float 102 about pivot point 98, thereby restoring the normal status of the burner.

ADVANTAGES

It is clear from the discussion above that the anti-flareup safety device is quite simple in construction, and can be readily and inexpensively incorporated in wick-fed barometric liquid fuel burners. Yet it will prevent flareup by providing a containment system for vapors from high-volatility fuels present in the vicinity of tank 60. Also, it provides a mechanism to prevent the re-insertion of removable tank 60 to its normal position into the burner when excess fuel is present in chamber 40.

The present device prevents the burning of fuel outside its intended site, that being at the wick, thereby saving fuel and reducing odor. Also, the device does not require any electrical power or electronic circuitry for the prevention of flareup.

Clearly, the device incorporates multiple safety features, which will make wick-fed, barometric liquid fuel burners safer to operate, and accordingly, will at the same time reduce the expensive lawsuits resulting from flareup incidents causing injury, loss of life, and property damage. As a result these burners will be easier to market.

RAMIFICATIONS AND SCOPE

Those skilled in the art can now appreciate from the foregoing description that the broad teachings of the present invention can be implemented in a variety of forms. Therefore, while the safety device has been described in connection with particular examples thereof, the true scope of the invention should not be so limited since other modifications will become apparent to the skilled practitioner upon a study of the drawings, specification and following claims.

For example, the shapes and composition of the various parts of the safety device can be varied greatly, so long as their function is preserved. Thus, while the cover plate is depicted as being rectangular, it can have other shapes, such as oval, square, triangular, etc., so long as it provides adequate containment for vapors in the vicinity of the removable tank. Plate 92 may alternatively be attached to tank 60 at its top, or at such a location along the height of tank 60 and around its perimeter, with the provision that sump 44 is of a height sufficient to contact plate 92.

The dimensions of the various components may be varied somewhat, so long as their functions are not adversely affected. The shape and size of float 102 may be varied, so long as it is responsive to the rise above level A in the fuel level in chamber 40, and it acts to prevent the engagement of pin 78 with plunger 27. The normal downward position of float 102 may be maintained by spring action or other appropriate mechanism, so long as it does not impair the ability of float to move to its most upward position in response to the presence of excess fuel in chamber 40, when tank 60 is lifted upward.

Also, the device may be connected to or used in combination with other safety devices, such as warning gauges, or shutoff mechanisms. The cover plate may be eliminated, or the tank-block mechanism may be eliminated.

Thus the scope of the invention should be determined, not by the examples given, but by the appended claims and their legal equivalents.

What is claimed is:

1. In an apparatus for preventing flareup in a liquid fuel burner of the type comprising (a) a removable liquid fuel tank, (b) a fuel chamber, (c) an automatic wick extinguishing unit, (d) a combustion chamber having a wick, (e) a reflector, (f) a cabinet having a lid over said removable tank, and (g) a tank guide which holds said tank in a vertical position in said cabinet, where said fuel chamber carries liquid fuel from said removable tank to said wick of said combustion chamber, the improvement comprising a vapor containment closure around said removable tank.

2. An apparatus according to claim 1, further including a fuel containment sump that encloses said removable tank and wherein said vapor containment closure comprises a cover plate that closes off and covers the top of said fuel containment sump.

3. An apparatus according to claim 1, further including a fuel containment sump that encloses said removable tank and a cover plate being attached to said lid, said vapor containment closure comprising said cover plate that closes off and covers the top of said fuel containment sump.

4. An apparatus according to claim 1, further including a fuel containment sump that encloses said removable tank and a cover plate being attached to said removable tank, said vapor containment closure comprising said cover plate that closes off and covers the top of said fuel containment sump.

5. An apparatus according to claim 1, further including means for providing a visual danger indication to alert the user of the dangerous condition of excess fuel in said fuel chamber.

6. A method of preventing flare-up in a liquid-fuel burner of the type comprising a liquid-fuel removable tank, a fuel chamber, an automatic wick-extinguishing unit, and a combustion chamber having a wick, a reflector, and a cabinet having a lid over said removable tank, where said fuel chamber carries liquid fuel from said removable tank to said wick of said combustion chamber, comprising the steps of:

containing vapors around said removable tank in a fuel containment sump that encloses said removable tank, said fuel containment sump being closed at the top by a cover plate; and preventing said removable tank from operatively reseating in said fuel chamber when the fuel level in said fuel chamber exceeds a predetermined level.

* * * * *